US009283426B2

(12) United States Patent
Robertson

(10) Patent No.: US 9,283,426 B2
(45) Date of Patent: Mar. 15, 2016

(54) PORTABLE MULTI-PURPOSE EXERCISE UNIT

(71) Applicant: Daniel Henry Robertson, Saratoga, CA (US)

(72) Inventor: Daniel Henry Robertson, Saratoga, CA (US)

( * ) Notice: Subject to any disclaimer, the term of this patent is extended or adjusted under 35 U.S.C. 154(b) by 0 days.

(21) Appl. No.: 14/684,419

(22) Filed: Apr. 12, 2015

(65) Prior Publication Data

US 2015/0367170 A1 Dec. 24, 2015

Related U.S. Application Data

(60) Provisional application No. 62/014,082, filed on Jun. 18, 2014.

(51) Int. Cl.

| | |
|---|---|
| ***A63B 21/072*** | (2006.01) |
| ***A63B 21/075*** | (2006.01) |
| ***A63B 21/00*** | (2006.01) |
| ***A63B 71/00*** | (2006.01) |
| ***A63B 22/20*** | (2006.01) |
| *A63B 21/06* | (2006.01) |

(52) U.S. Cl.

CPC ..... *A63B 22/20* (2013.01); *A63B 21/0004* (2013.01); *A63B 21/00065* (2013.01); *A63B 21/4035* (2015.10); *A63B 21/06* (2013.01); *A63B 21/072* (2013.01); *A63B 21/0724* (2013.01)

(58) Field of Classification Search

CPC ..... A63B 21/0004; A63B 21/00058; A63B 21/00061; A63B 21/00065; A63B 21/072; A63B 21/0722; A63B 21/0724; A63B 21/0726; A63B 21/0728; A63B 21/075; A63B 21/078; A63B 21/0783; A63B 21/4033; A63B 21/4035; A63B 21/4041; A63B 21/4043; A63B 21/4049; A63B 22/00; A63B 22/0002; A63B 22/0005; A63B 22/0007; A63B 22/001; A63B 22/0012; A63B 22/0015; A63B 22/0017; A63B 22/0046; A63B 22/20; A63B 22/201; A63B 22/203; A63B 22/208; A63B 23/02; A63B 23/0205; A63B 23/0211; A63B 23/0233; A63B 23/035; A63B 23/03508; A63B 23/03516; A63B 23/03525; A63B 23/03533; A63B 23/03541; A63B 23/0355; A63B 23/12; A63B 23/1209; A63B 23/1236; A63B 23/1245; A63B 23/1281; A63B 23/16; A63B 2208/00; A63B 2208/02; A63B 2208/0214; A63B 2208/0219; A63B 2208/0242; A63B 2208/0247; A63B 2208/0257; A63B 2208/0261; A63B 2208/0295; A63B 25/04; A63B 2022/0035; A63B 2022/0041; A63B 2022/206; B62B 3/00; B62B 3/008; B62B 2207/00; B62B 2207/02

USPC ..... 482/49, 50, 92, 93, 104, 106–108, 482/131–133, 135–140, 142, 146–148

See application file for complete search history.

(56) References Cited

U.S. PATENT DOCUMENTS 3,809,393 A * 5/1974 Jones ..... A63B 22/20 482/132
6,254,518 B1 * 7/2001 Yu ..... A63B 21/0004 482/132

(Continued)

*Primary Examiner* — Oren Ginsberg
*Assistant Examiner* — Joshua Lee

(57) ABSTRACT

The present disclosure in an embodiment provides a portable exercise apparatus. The portable exercise apparatus comprises a bar having a first end and a second end along a longitudinal axis. Further, the portable exercise apparatus comprises two frame members. Each frame member comprises a groove on top, coupled to the bar such that the bar rests on the two frame members along the longitudinal axis of the bar and on the grooves of the two frame members. The two frame members are opposite to each other at each end of the bar. Further, each frame member is coupled to a pair of wheels at a bottom portion of each frame member. Further, the bar has a grip portion, between the first end and the second end, to support stresses perpendicular to the longitudinal axis of the bar.

14 Claims, 23 Drawing Sheets

(56) References Cited

U.S. PATENT DOCUMENTS

2013/0217549 A1* 8/2013 Marji ..... A63B 21/068
482/132

2014/0018217 A1* 1/2014 Brown ..... A63B 22/20
482/132

2014/0371040 A1* 12/2014 Vasquez ..... A63B 1/00
482/132

* cited by examiner

PORTABLE MULTI-PURPOSE EXERCISE UNIT

The present application is based on, and claims priority from, U.S. application Ser. No. 62/014,082, filed on 18 Jun. 2014, the disclosure of which is hereby incorporated by reference herein.

TECHNICAL FIELD

The embodiments herein generally relate to exercise equipment. More particularly, relates to a portable exercise apparatus that can be configured in different combinations to perform a wide range of exercises for strengthening various groups of muscles.

BACKGROUND

Exercise is known to be an important part of a healthy lifestyle. A variety of portable exercise equipments have emerged that permit a user to perform a limited range of exercises which may include exercising only one or a few portions of the body. Most of such exercise equipments are designed to work out certain groups of muscles by constraining the motion of the user. Additionally, it is practically not possible to control the intensity of the stress exerted with available portable exercise equipments.

In order to perform full body workout or different types of exercises using available portable exercise equipment, a variety of different independent equipments would be required that, in total, would be bulky, heavy, costly, and not practicably portable. Thus, a user wishing to engage in different types of exercises may need to acquire multiple pieces of exercise equipment, taking up home space. A gym seeking to provide a wide range of exercises needs to purchase and position many different types of equipments, also occupying available space. Aside from the space limitations, installing or configuring multiple machines also engenders other deficiencies such as time required for set-up, specialized training of gym personnel or individual user, learning period for the users, maintenance, cleaning, and the like.

Accordingly, there is a need for a portable exercise apparatus that is relatively compact, and that can be used for more than one type of exercise targeting a specific or various muscles and muscle groups. Also, there is a need to provide a portable multi-propose exercise system that assists the user in making smooth, targeted movements during the workout in a controlled and safe manner.

The above information is presented as background information only to help the reader to understand the present invention. Applicants have made no determination and make no assertion as to whether any of the above might be applicable as Prior Art with regard to the present application.

SUMMARY

The embodiment herein provides a portable exercise apparatus. The portable exercise apparatus comprises a bar having a first end and a second end along a longitudinal axis. Further, the portable exercise apparatus comprises two frame members. Each frame member comprises a groove on top, coupled to the bar such that the bar rests on the two frame members along the longitudinal axis of the bar and on the grooves of the two frame members. The two frame members are opposite to each other at each end of the bar. Further, each frame member is coupled to a pair of wheels at a bottom portion of each frame member. Further, the bar has a grip portion, between the first end and the second end, to support stresses perpendicular to the longitudinal axis of the bar.

The present disclosure in an embodiment also provides a portable exercise assembly. The portable exercise assembly comprises a first exercise apparatus, a second exercise apparatus, and a coupling member. The first exercise apparatus comprises a bar, having a first end and a second end along a longitudinal axis, connected to two frame members. Each frame member is coupled to a pair of wheels at a bottom portion of each frame member. The second exercise apparatus comprises a bar, having a first end and a second end along the longitudinal axis, connected to two frame members. Each frame member is coupled to a pair of wheels at a bottom portion of each frame member. The coupling member selectively couples the first exercise apparatus and the second exercise apparatus for performing exercises by a user.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications can be made within the scope of the embodiments herein without departing from the spirit thereof, and the embodiments herein include all such modifications.

BRIEF DESCRIPTION OF FIGURES

This embodiment is illustrated in the accompanying drawings, throughout which like reference letters indicate corresponding parts in the various figures. The embodiments herein will be better understood from the following description with reference to the drawings, in which.

DETAILED DESCRIPTION OF EMBODIMENT

Figure 1A:
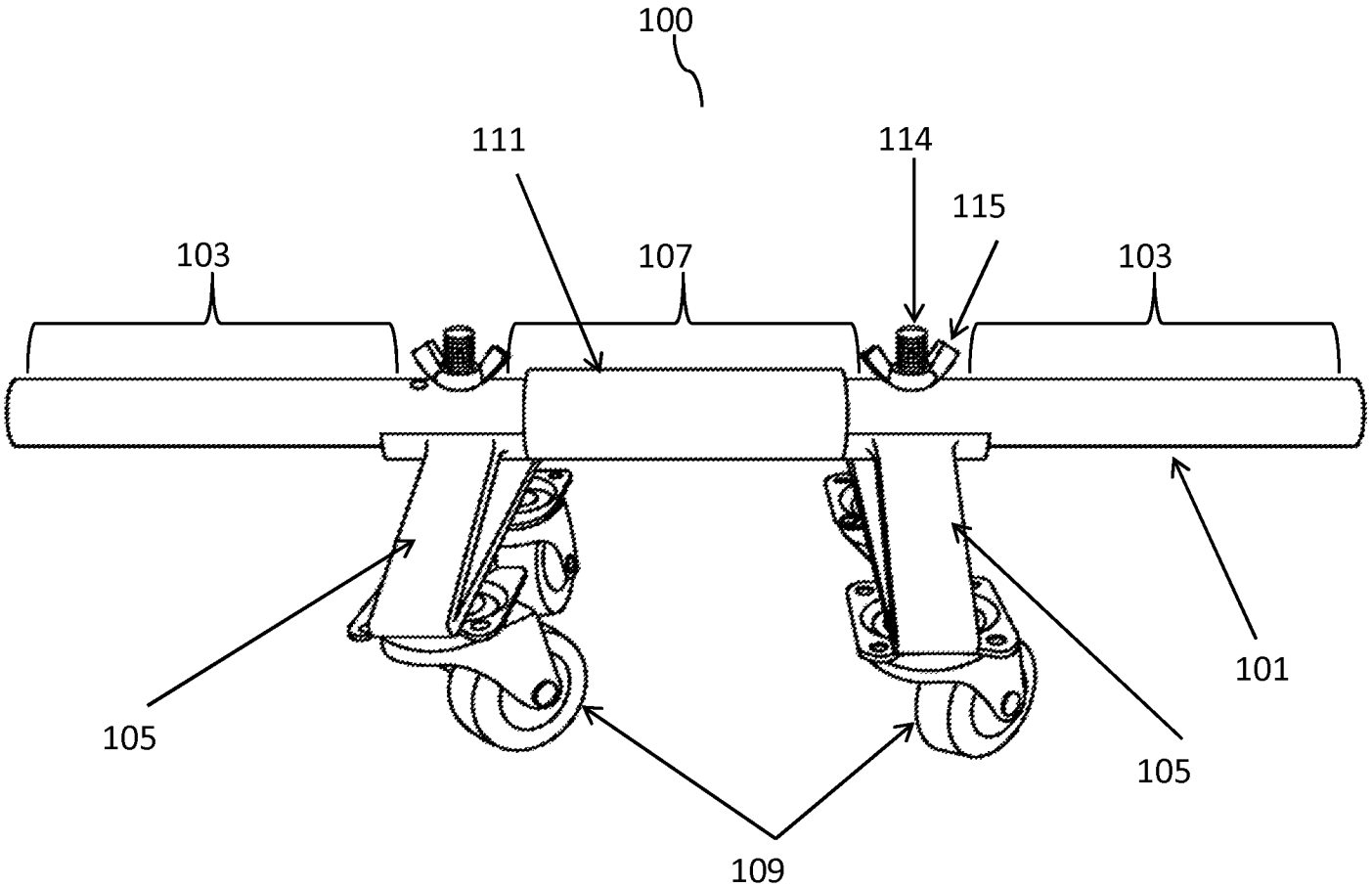
FIG. 1*a* illustrates a front view of a portable exercise apparatus, according to the embodiments as disclosed herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. Also, the various embodiments described herein are not necessarily mutually exclusive, as some embodiments can be combined with one or more other embodiments to form new embodiments. The term "or" as used herein, refers to a non-exclusive or, unless otherwise indicated. The examples used herein are intended merely to facilitate an understanding of ways in which the embodiments herein can be practiced and to further enable those skilled in the art to practice the embodiments herein. Accordingly, the examples should not be construed as limiting the scope of the embodiments herein.

The embodiments herein provide a portable exercise apparatus. The portable exercise apparatus comprises a bar having a first end and a second end along a longitudinal axis. Further, the portable exercise apparatus comprises two frame members. Each frame member has a groove on the top and is coupled to the bar such that the bar rests on the two frame members along the longitudinal axis of the bar and on the grooves of the two frame members. The two frame members are opposite to each other at each end of the bar. Further, each frame member is coupled to a pair of wheels at a bottom portion of each frame member. The bar also has a grip portion between the first end and the second end, to support stresses perpendicular to the longitudinal axis of the bar. The first end and the second end extend beyond each frame member and are configured for attachment of free-weights.

In one embodiment, each frame member is an "A-shaped" frame having three flat bar segments connected in a triangular pattern. The bar is coupled to a top portion of each frame member by means of a bolt and a nut.

In one embodiment, each frame member comprises a bottom portion and a top portion. The top portion is a cap screwed to the bottom portion using two screws on each side of the bar. The bottom portion comprises the groove on top of the bottom portion and a nib on the groove for the bar to rest on each frame member without rotating. The bar is coupled to the top portion of each frame member by way of a hole resting on a nib on the groove.

Further, the pair of wheels is adjustably attached at the bottom portion of each frame member by means of a nut and a bolt. Alternatively, the pair of wheels is adjustably attached at the bottom portion of each frame member by means of at least one of a pin, axle, axis, and pivot. Each wheel spins in every direction to spin the portable exercise apparatus in any direction.

The embodiments herein also provide a portable exercise assembly. The portable exercise assembly comprises a first exercise apparatus, a second exercise apparatus, and a coupling member. The first exercise apparatus comprises a bar, having a first end and a second end along a longitudinal axis, connected to two frame members. Each frame member is coupled to a pair of wheels at a bottom portion of each frame member. The second exercise apparatus comprises a bar, having a first end and a second end along the longitudinal axis, connected to two frame members. Each frame member is coupled to the pair of wheels at the bottom portion of each frame member. The coupling member selectively couples the first exercise apparatus and the second exercise apparatus for performing exercises by a user.

The first end and the second end of the first exercise apparatus and the second exercise apparatus extends beyond each frame member and is configured for attachment of free-weights. The portable exercise assembly is adapted to rotate about an axis during an exercise performed by the user. The user performs the exercise by grasping a grip portion of the bar of the first exercise apparatus and a grip portion of the bar of the second exercise apparatus. The bar of the first exercise apparatus and the bar of the second exercise apparatus are perpendicular to a vertical axis of each frame member. The coupling member comprises a plurality of slots for engaging a bolt and nut assembly for coupling one of the first end and the second end of the first exercise apparatus and one of the first end and the second end of the second exercise apparatus.

The portable exercise apparatus described herein enables a user to exercise specific or various muscles and muscle groups through at least one mode of operation including a configuration preferable to safely perform the exercise. In one embodiment, the portable exercise apparatus acts as a dumbbell unit as free-weights can be attached at the first end and the second of the bar. The various structural configurations of the dumbbell unit are designed to assist the user for performing various types of exercises. The pair of wheels on the dumbbell unit enables the user to roll the dumbbell unit in any direction creating different desirable workloads. When the dumbbell unit is not rolled on the floor, the user can also apply more plate weights and perform traditional well known free weight exercises.

Further, the portable exercise apparatus can be arranged in various adjustable configurations to perform full body strength training and cardiovascular exercises, which may compliment the fields of physical therapy, sports performance, and bodybuilding. It is well accepted in these fields that various functional workloads that offer real life movement, appropriate stability, coordination, and specific muscle emphasis are highly beneficial for enhanced performance. Further, the portable exercise apparatus enables the versatility of using less equipment by configuring two dumbbell units in different configurations to perform the traditionally known exercises. The portable exercise apparatus is configured to allow a user to perform multiple exercises in a compact form that may be easily stored, or integrated into articles of furniture. Furthermore, the portable exercise apparatus can be designed and implemented using existing components and may not require extensive set-up and instrumentations. Additional features and advantages of the embodiment will be set forth in the descriptions that follow and in part will be apparent from the description, or may be learned by practice of the embodiment.

Referring now to the drawing, and more particularly to FIG. 1 through FIG. 10, where similar reference characters denote corresponding features consistently throughout the figure, there are shown preferred embodiments.

FIG. 1*a* illustrates a front view of a portable exercise apparatus, according to the embodiments as disclosed herein. In an embodiment, the portable exercise apparatus 100 comprises a bar 101 having a first end 103 and second end 103 along a longitudinal axis. The portable exercise apparatus 100 comprises two frame members 105. Each frame member 105 has a groove on top and is coupled to the bar 101 such that the bar 101 rests on the two frame members 105 along the longitudinal axis of the bar 101 and on the grooves of the two frame members 105. The two frame members 105 are opposite to each other at each end of the bar 101.

The bar 101 also has a grip portion 107 between the first end 103 and the second end 103, to support stresses perpendicular to the longitudinal axis of the bar 101. The first end 103 and the second end 103 extend beyond each frame member 105 and are configured for attachment of free-weights. Further, each frame member 105 is coupled to a pair of wheels 109 at a bottom portion.

In one embodiment, each frame member 105 is an "A-shaped" frame having three flat bar segments connected in a triangular pattern. The frame member 105 may be constructed using a strong, rigid material such as metal or the like. The bar 101 is coupled to a top portion of each frame member 105 by means of a bolt and a nut.

In one embodiment, the bar 101 is provided with a plurality of openings for engagement of the bar 101 with a bolt 114 on the top portion of the frame member 105. Further, each bolt 114 is provided with a wing nut 115 to firmly lock the bar 101 to the frame member 105. Between the two "A" shaped frame members 105, a sliding hand grip sleeve 111 covering the grip portion 107 is provided to offer more comfort to the user.

In one embodiment, the pair of wheels 109 can be attached at corners of each frame member 105 on the bottom portion of the frame member 105. The pair of wheels 109 is adjustably attached at the bottom portion of each frame member 105 by means of a nut and a bolt. Alternatively, the pair of wheels 109 is adjustably attached at the bottom portion of each frame member 105 by means of at least one of a pin, axle, axis, and pivot. Each wheel 109 spins in every direction to spin the portable exercise apparatus 100 in any direction.

As the pair of wheels 109 on each frame member 105 can spin in any horizontal direction, the user is allowed to roll the portable exercise apparatus 100 in any direction, at a given time, creating different desirable workloads.

Figure 1B:
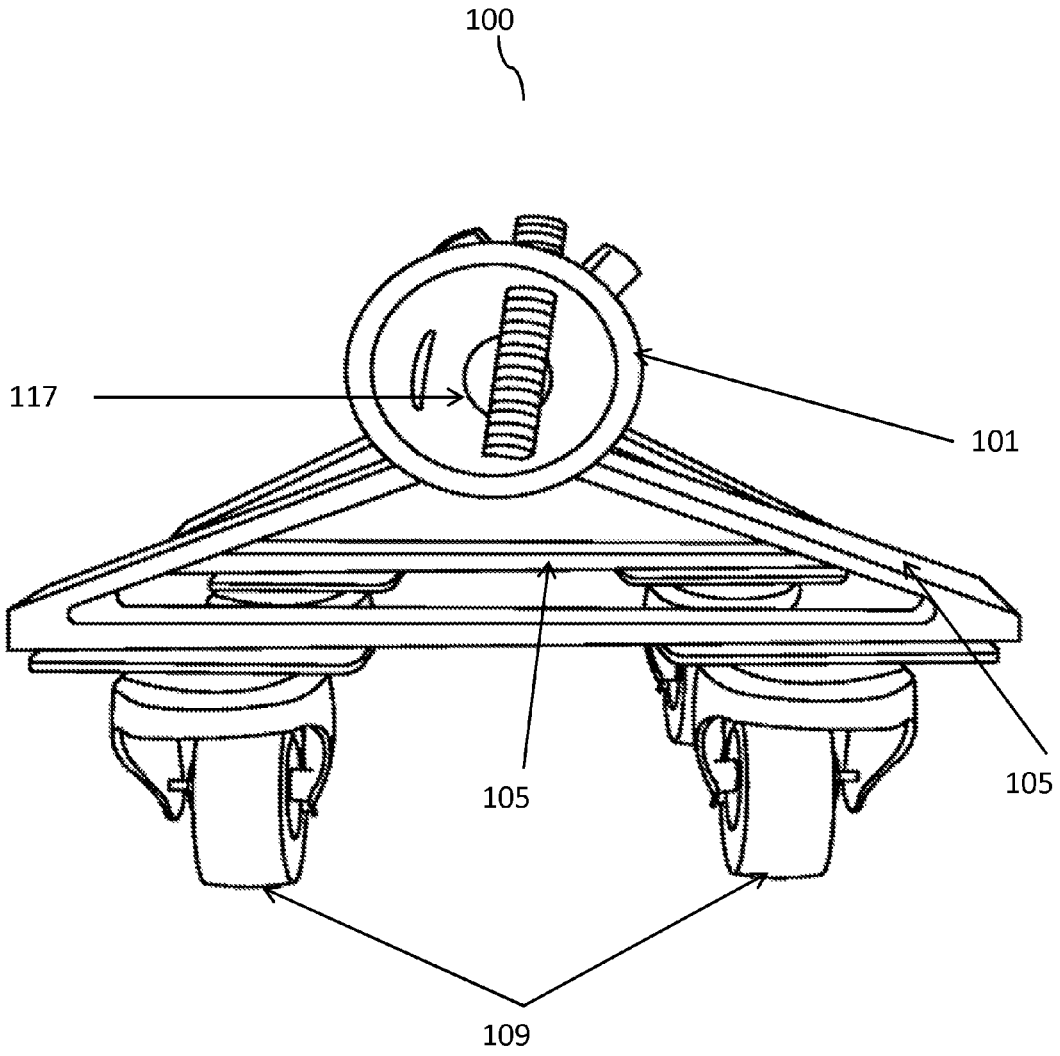
FIG. 1*b* illustrates a side view of the portable exercise apparatus, according to the embodiments as disclosed herein.

FIG. 1*b* illustrates a side view of the portable exercise apparatus 100, according to the embodiments as disclosed herein. As shown in the FIG. 1*b*, the "A" frame members 105 are arranged opposite to each other. The frame members 105 may be made up of strong, rigid material such as metal or the like. The bar 101 is fixedly mounted to the upper part of the frame member 105. The bar 101 comprises a hollow, cylindrical bar segment 117, which is made of a strong, rigid material such as metal or the like.

Figure 1C:
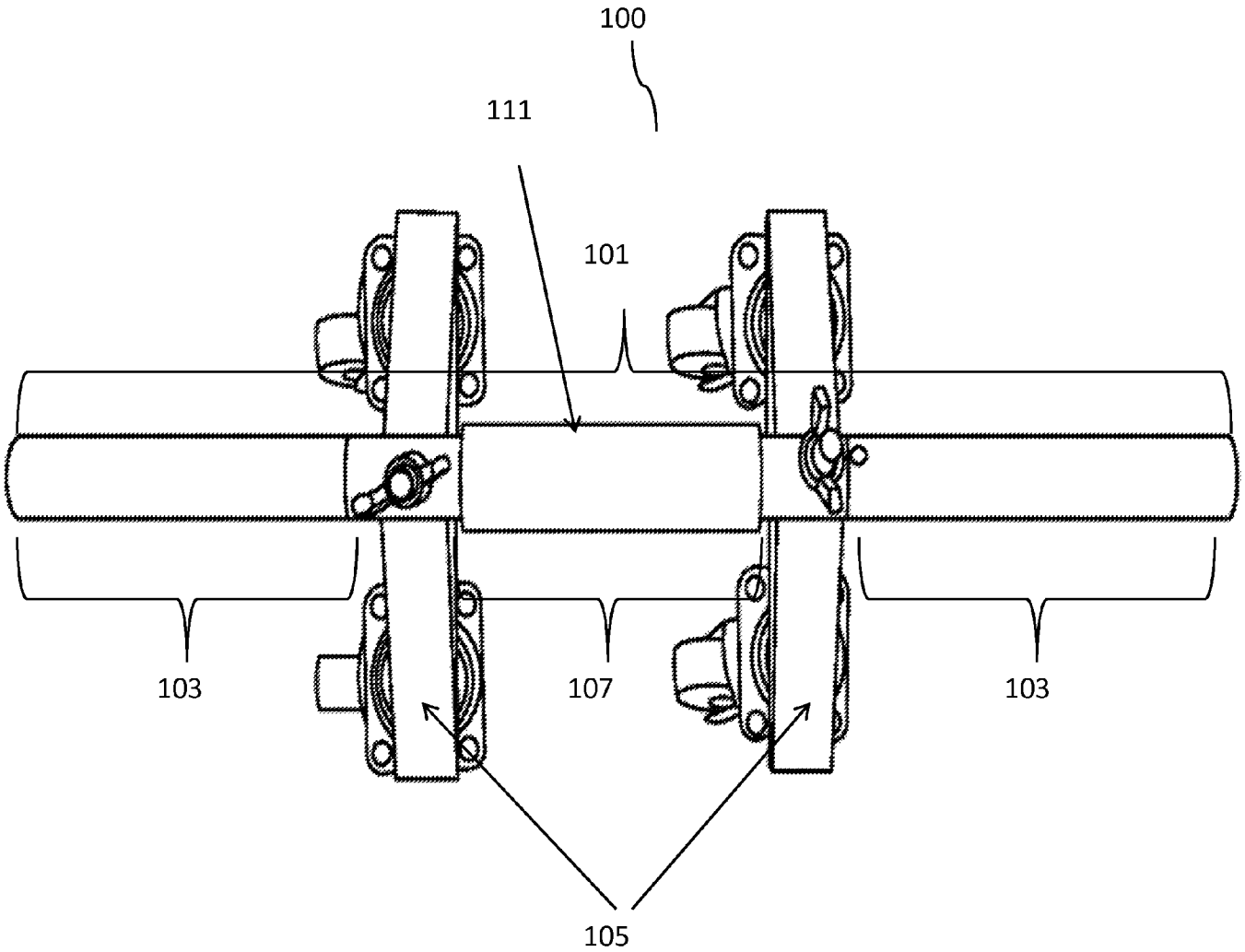
FIG. 1*c* illustrates a top view of the portable exercise apparatus, according to the embodiments as disclosed herein.

FIG. 1*c* illustrates a top view of the portable exercise apparatus 100, according to the embodiments as disclosed herein. In an embodiment, the grip portion 107 of the bar 101 forms a mid-section and the first end 103 and the second end 103 extend beyond the frame members 105 at both the sides. The grip portion 107 preferably has a gripping surface such as a sliding hand grip sleeve 111 made of, for example, but not limited to, a PVC, plastic, rubberized or elastomeric material.

Figure 1D:
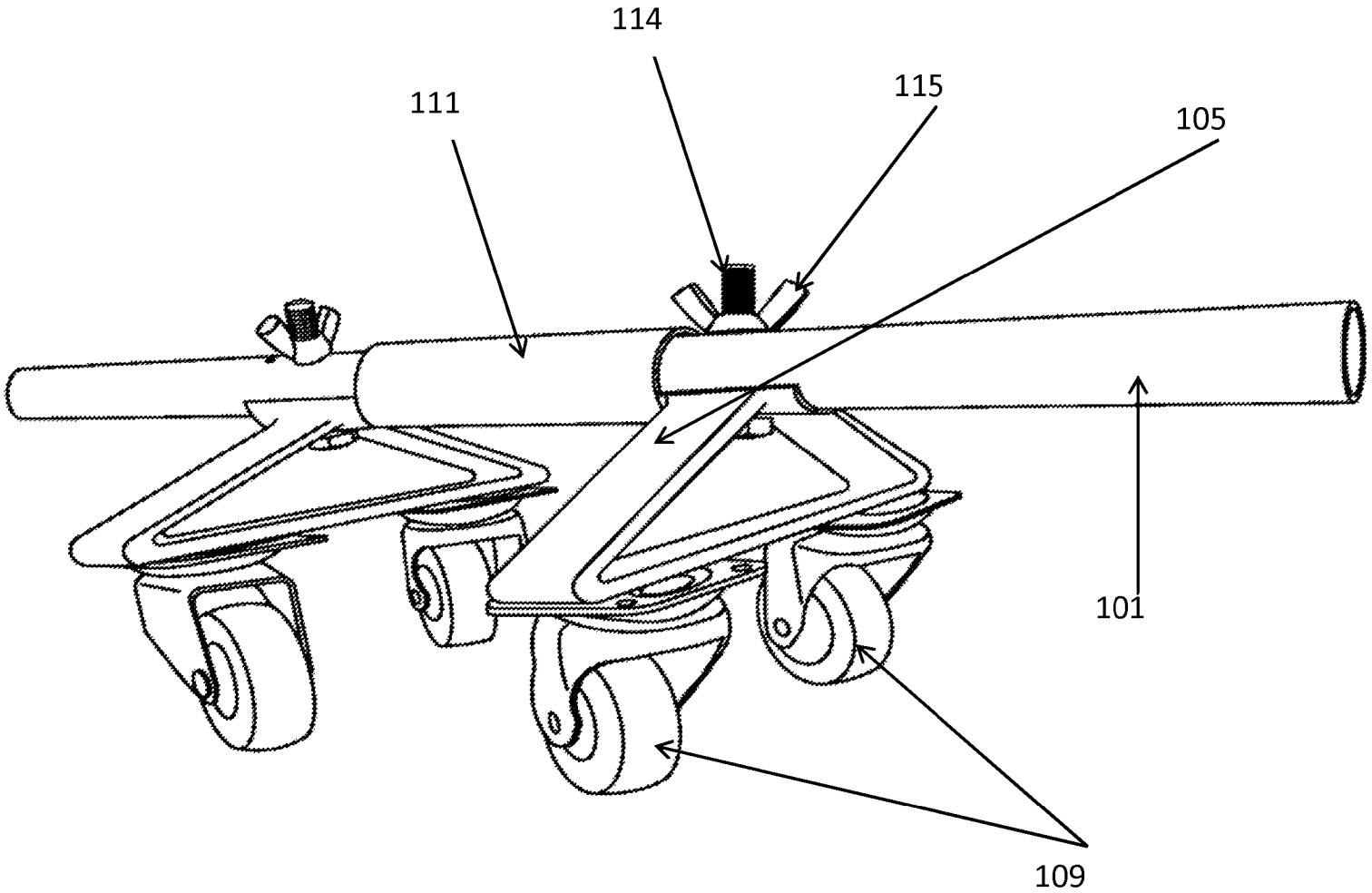
FIG. 1*d* illustrates a side perspective view of the portable exercise apparatus, according to the embodiments as disclosed herein.

FIG. 1*d* illustrates a side perspective view of the portable exercise apparatus 100, according to the embodiments as disclosed herein. In an embodiment, the bar 101 is fixedly mounted to the top portion of the frame member 105. Each frame member 105 has a groove on top and is coupled to the bar 101 such that the bar 101 rests on the two frame members 105 along the longitudinal axis of the bar 101 and on the grooves of the two frame members 105.

In one embodiment, the bar 101 is provided with a plurality of openings for engagement of the bar 101 with the bolt 114 on the top portion of the frame member 105. Each bolt 114 is provided with the wing nut 115 to firmly lock the bar 101 to the frame member 105.

Figure 2A:
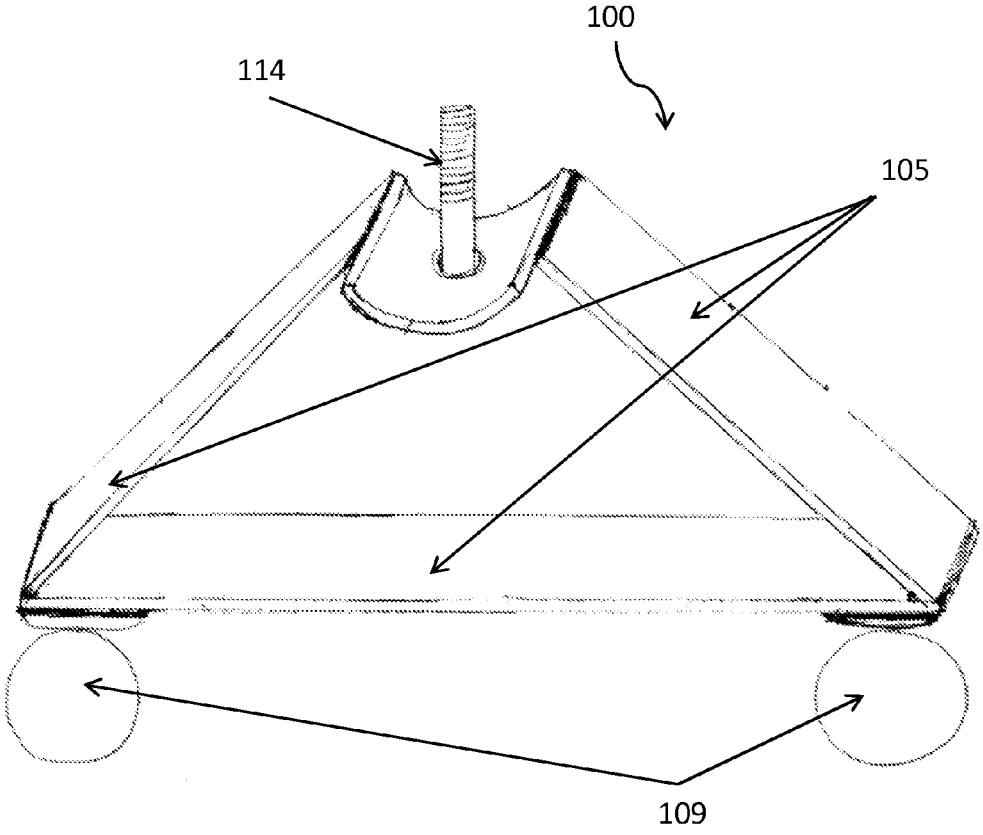
FIGS. 2*a* and 2*b* illustrate cross-sectional front views of the portable exercise apparatus, according to the embodiments as disclosed herein.
Figure 2B:
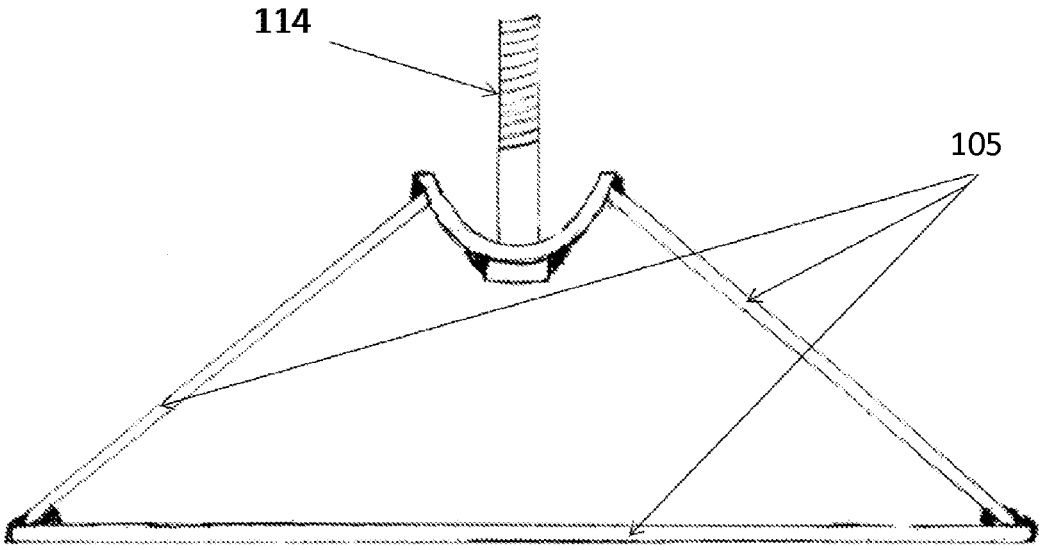

FIGS. 2*a* and 2*b* illustrate cross-sectional front views of the portable exercise apparatus, according to the embodiments as disclosed herein. As shown in the FIGS. 2*a* and 2*b*, the bolt 114 described herein can have a T-shaped cross-section which is provided at the top portion of the frame member 105. The bolt 114 includes a threaded shank which extends from the top portion of each frame member 105 for mounting and locking the bar 101 to the top portion of the frame member 105. In one embodiment, the bar 101 is provided with plurality of openings for engagement of the bar 101 with the bolt 114 on the top portion of the frame member 105. Further, each bolt 114 is provided with the wing nut 115 to firmly lock the bar 101 to the frame member 105.

Figure 2C:
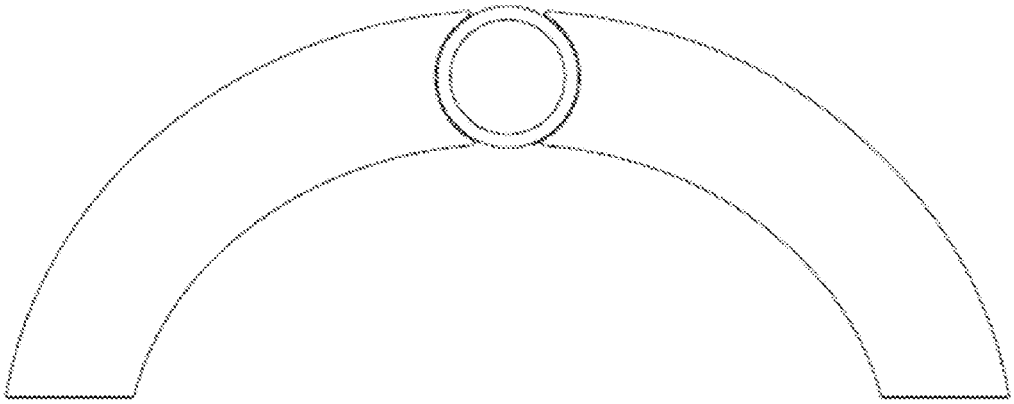
FIG. 2*c* illustrates a tube used to construct "A" frame of the portable exercise apparatus, according to the embodiments as disclosed herein.

FIG. 2*c* illustrates a tube used to construct the "A" frame member 105 of the portable exercise apparatus 100, according to the embodiments as disclosed herein. In an embodiment, the tubing structure described herein can be made of, for example, but not limited to, plastic, steel, and the like. The tube can be used to design or construct the "A" frame members 105.

Figure 3:
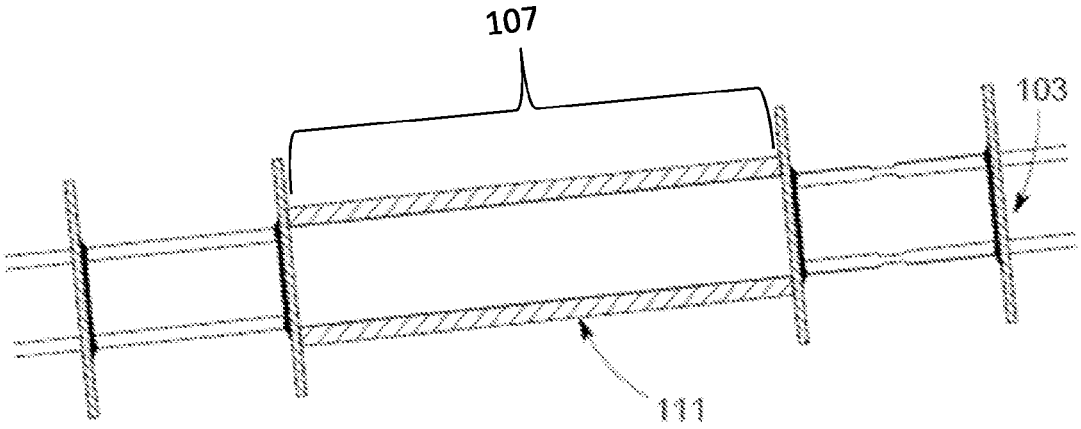
FIG. 3 illustrates a front view of a grip portion of the portable exercise apparatus, according to the embodiments as disclosed herein.

FIG. 3 illustrates a front view of the grip portion 107 of the portable exercise apparatus 100, according to the embodiments as disclosed herein. In an embodiment, the bar 101 can include a hollow, cylindrical bar segment 117, which is made of a strong, rigid material such as metal or the like. The grip portion 107 of the bar 101 forms the mid-section. The first end 103 and the second end 103 of bar 101 extend beyond the frame members 105 at both the sides. Between the two "A" frame members 105, the sliding hand grip sleeve 111 covering the grip portion 107 is provided to offer more comfort to the user.

FIGS. 4*a*-4*d* illustrate a side perspective view and a front view of a washer unit of the portable exercise apparatus 100, according to the embodiments as disclosed herein. In an embodiment, the portable exercise apparatus 100 is provided with the washers 112 which are welded at the top portion of the frame member 105 as shown in the FIGS. 4A and 4B. The washer 112 can include a central hollow portion 113 through which the bar 101 is passed for mounting and locking the top portion of the frame member 105. The bar 101 is provided with a groove for engagement of the bar 101 with the bolt 114 provided on the top portion of the frame member 105. Further, each bolt 114 is provided with the wing nut 115 to firmly lock the bar 101 to the frame member 105. The washers 112 can be connected to the frame member 105 using a bolt that comes through the bar 101, such as show in the FIG. 4C.

Figure 4A:
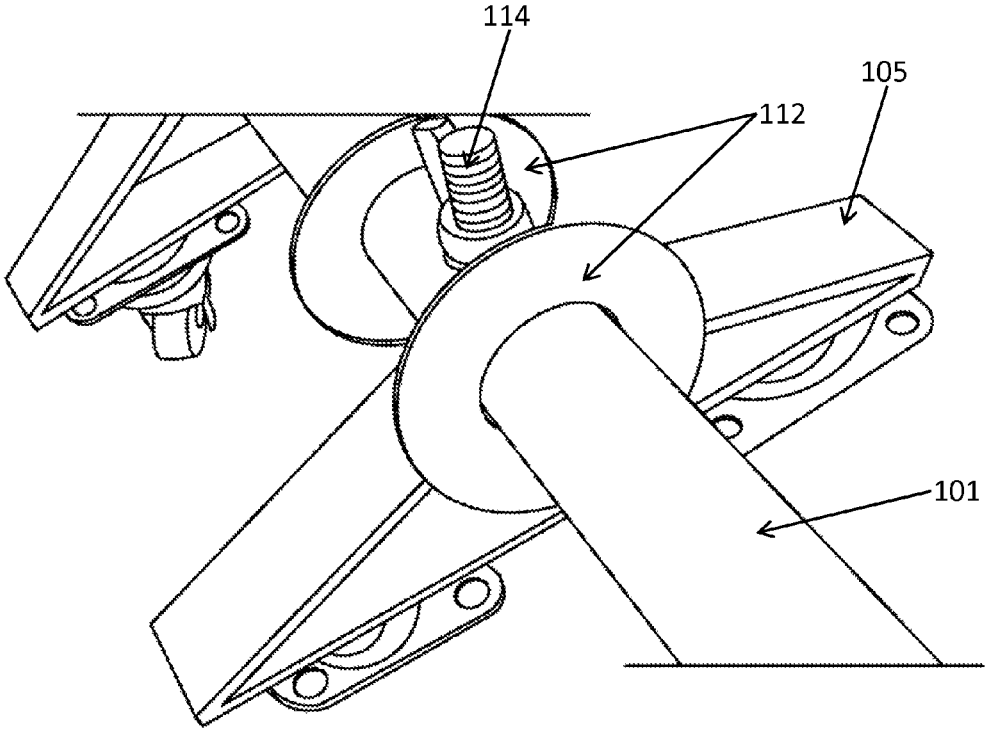
FIGS. 4*a*-4*d* illustrate a side perspective view and a front view of a washer unit of the portable exercise apparatus, according to the embodiments as disclosed herein.
Figure 4B:
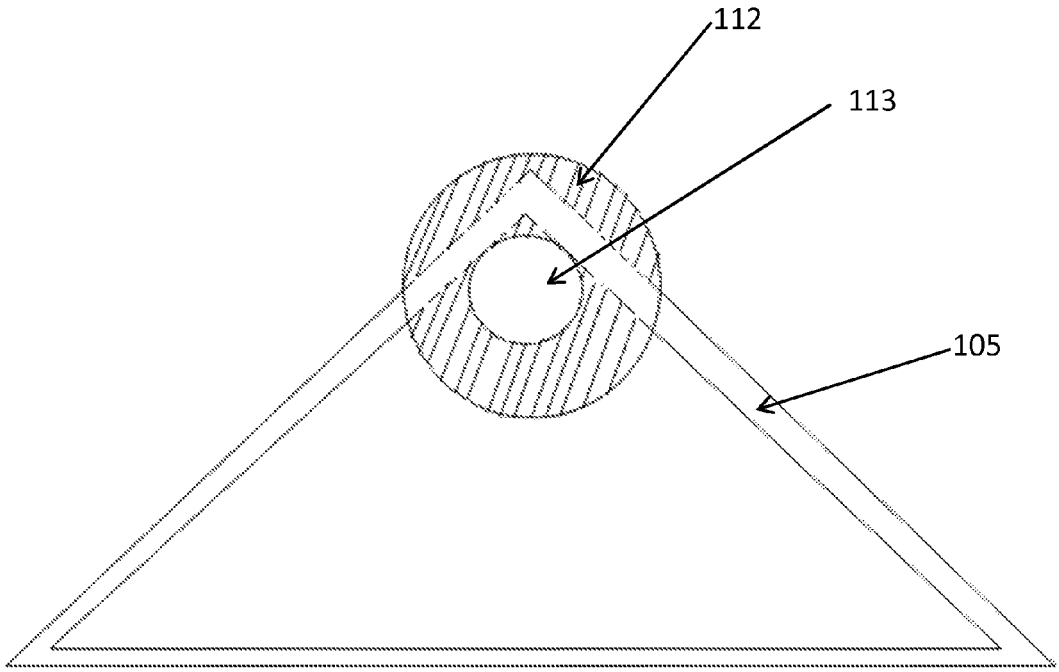
Figure 4C:
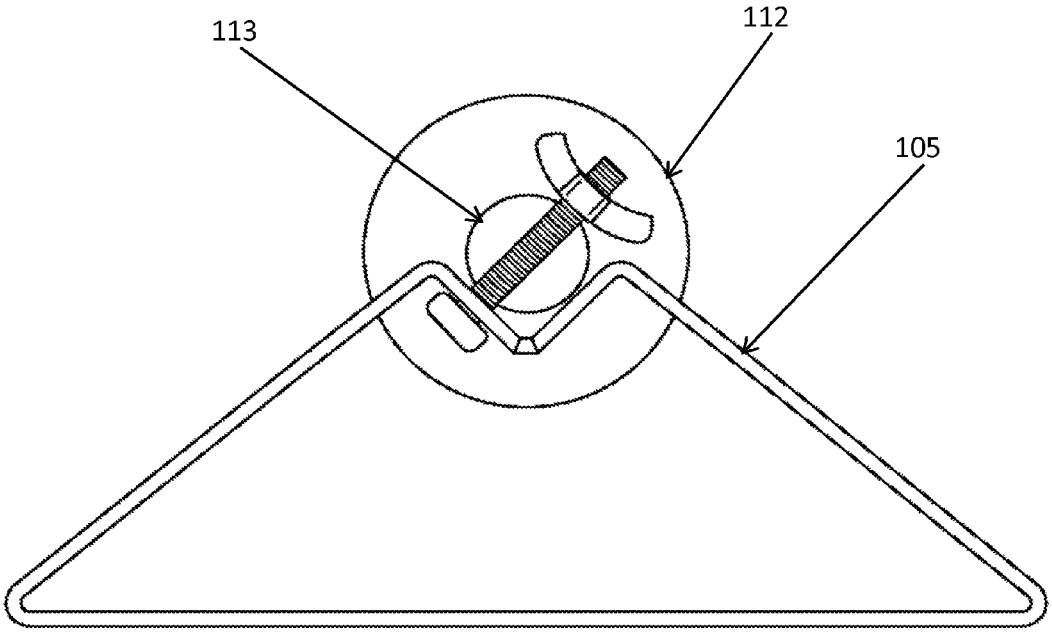
Figure 4D:
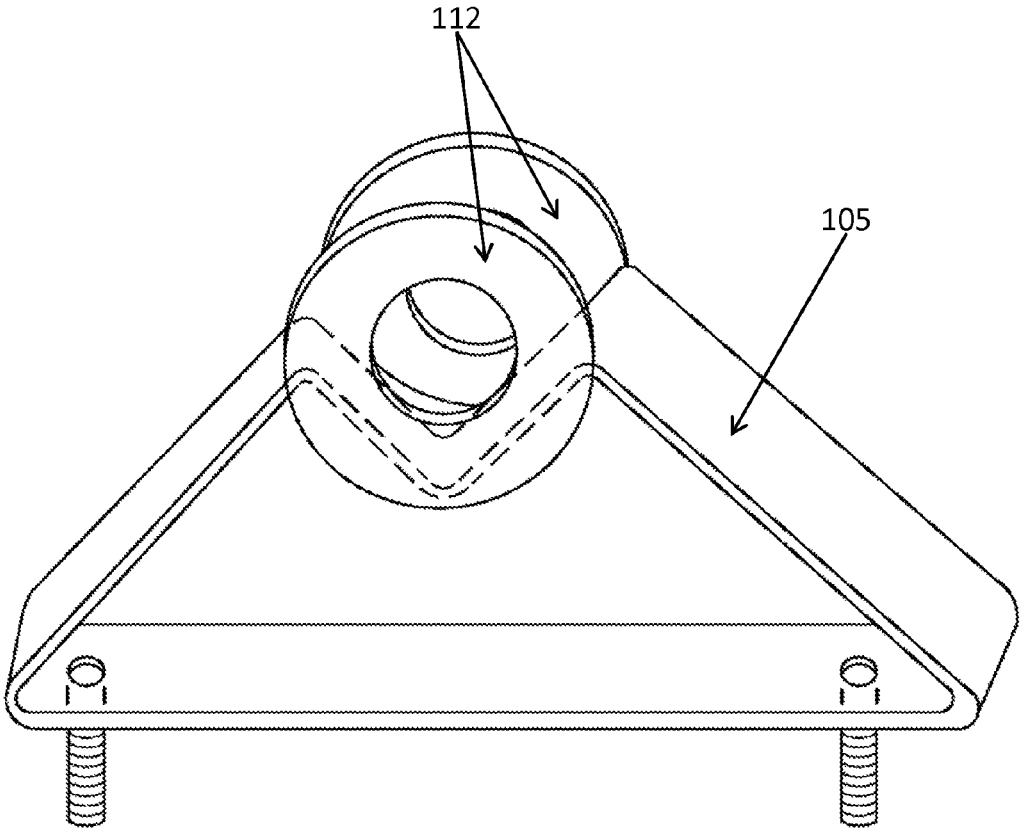

In an embodiment, the FIG. 4D shows a three dimensional view of the washers 112 welded with 90 degree bend at the top of the frame member 105 and then is welded together at the top portion of the frame member 105.

Figure 5:
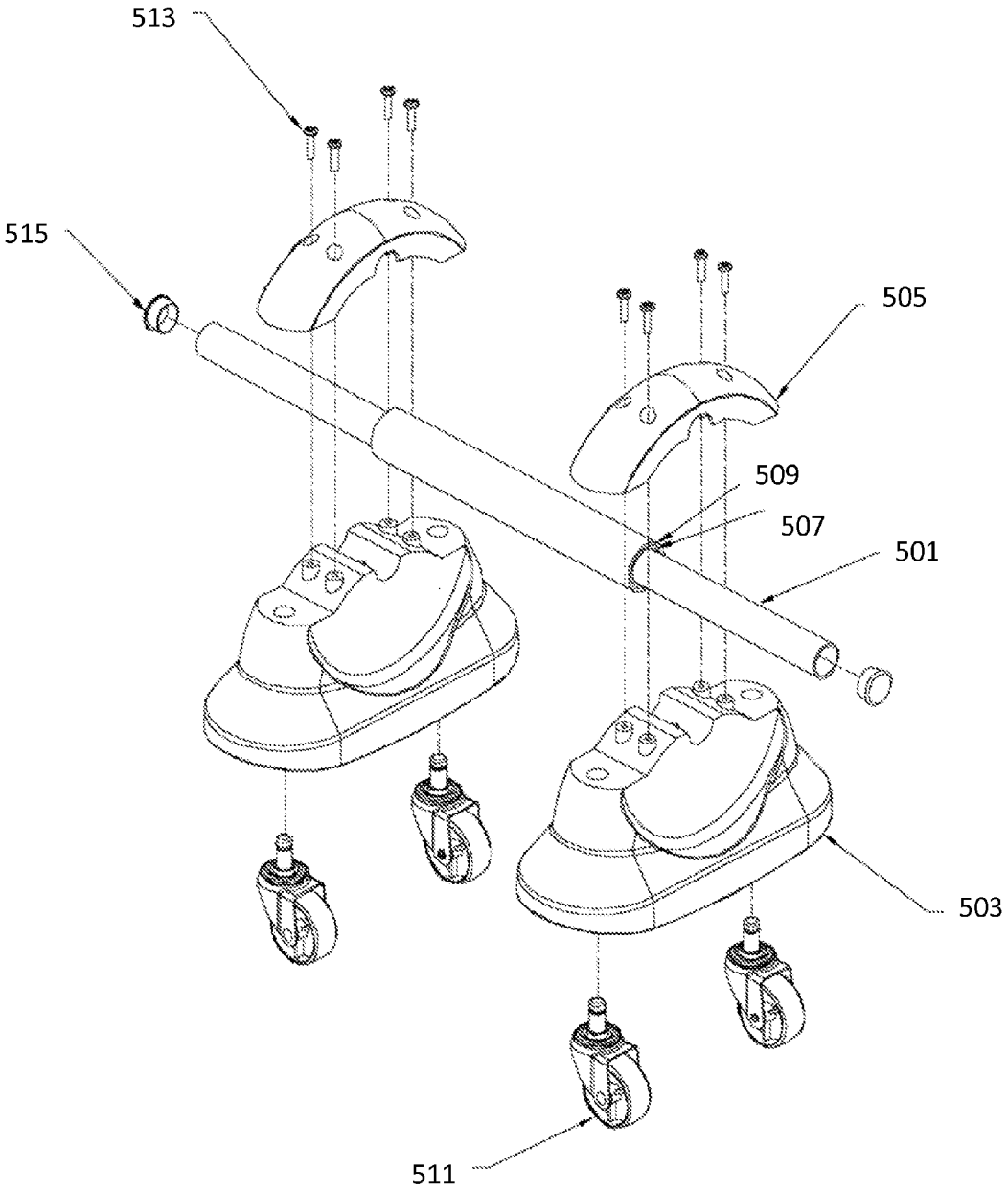
FIG. 5 illustrates an exploded view of the portable exercise apparatus, according to the embodiments as disclosed herein.

FIG. 5 illustrates an exploded view of the portable exercise apparatus 100, according to the embodiments as disclosed herein. The portable exercise apparatus 100 comprises a bar 501 having a first end and a second end along a longitudinal axis. Further, the portable exercise apparatus 100 comprises two frame members. Each frame member has a groove on the top and is coupled to the bar 501 such that the bar 501 rests on the two frame members along the longitudinal axis of the bar 501 and on the grooves of the two frame members. The two frame members are opposite to each other at each end of the bar 501.

In one embodiment, each frame member comprises the bottom portion 503 and the top portion 505. The top portion 505 is a cap screwed to the bottom portion 503 using two screws 513 on each side of the bar 501. The bottom portion 503 comprises the groove on top of the bottom portion 503 and a nib on the groove for the bar 501 to rest on each frame member without rotating. The bottom portion 503 of each member is a single piece and may be cast molded. The bottom portion 503 can be solid or casted with specific hollow pattern to make it stronger. The bar 501 is coupled to the top portion 505 of each frame member by way of a hole resting on a nib on the groove.

The bar 501 also has a plastic tube 507 comprising a grip portion 509 between the first end and the second end, to support stresses perpendicular to the longitudinal axis of the bar 501. The first end and the second end extend beyond each frame member and are configured for attachment of free-weights. The bar 501 may also comprise a plastic cap 515 at each end.

Further, each frame member is coupled to a pair of wheels 511 at the bottom portion 503 of each frame member. Further, the pair of wheels 511 is adjustably attached at the bottom portion 503 of each frame member by means of a nut and a bolt. Alternatively, the pair of wheels 511 is adjustably attached at the bottom portion 503 of each frame member by means of at least one of a pin, axle, axis, and pivot. Each wheel spins in every direction to spin the portable exercise apparatus 100 in any direction.

Figure 6:
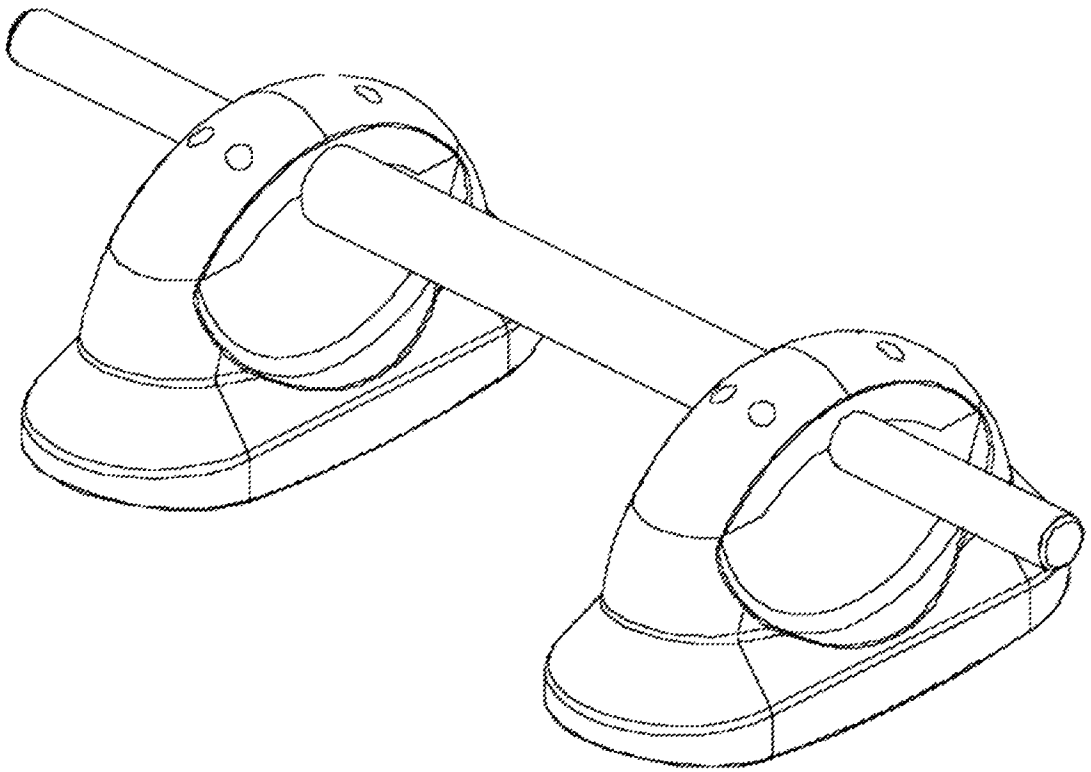
FIG. 6 illustrates an assembled view of the portable exercise apparatus, according to the embodiments as disclosed herein.

FIG. 6 illustrates an assembled view of the portable exercise apparatus 100 as described in the FIG. 5, according to the embodiments as disclosed herein.

Figure 7:
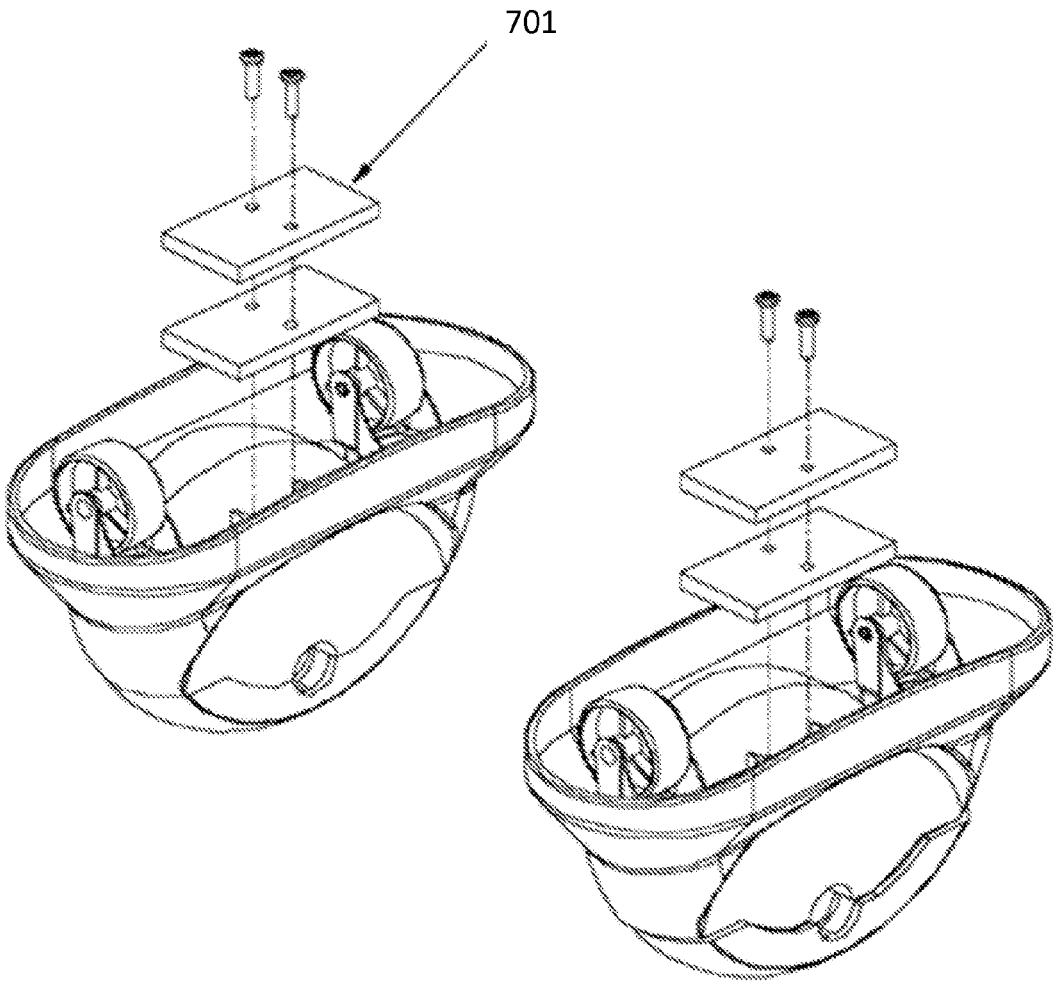
FIG. 7 illustrates bottom view of each frame member of the portable exercise apparatus, according to the embodiments as disclosed herein.

Further, FIG. 7 illustrates a bottom view of each frame member of the portable exercise apparatus 100 described in the FIG. 5, according to the embodiments as disclosed herein. One or more weights 701 may be attached to the bottom portion 503 of the frame member using two screws.

Figure 8A:
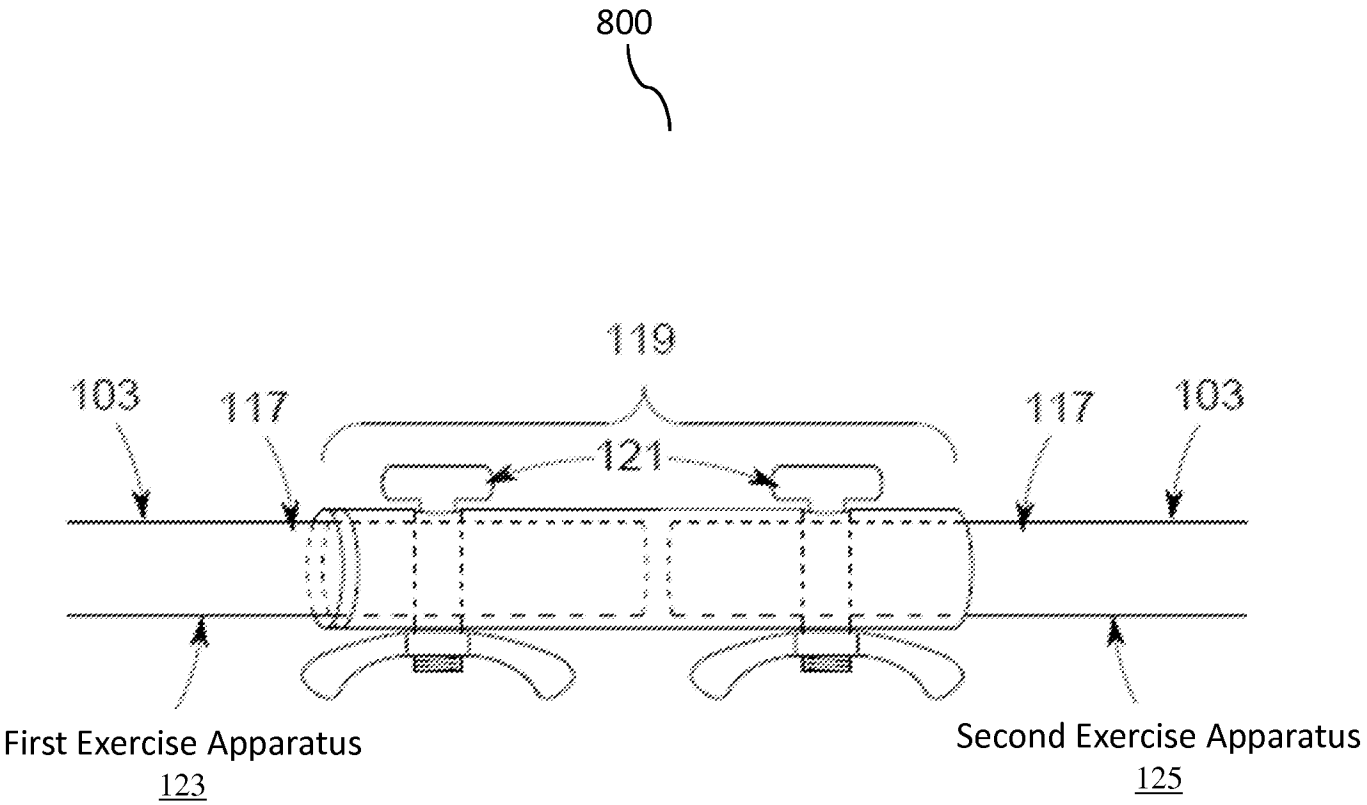
FIGS. 8*a* and 8*b* illustrate a front view of a portable exercise assembly including the first exercise apparatus and the second exercise apparatus selectively coupled using a coupling member, according to the embodiments as disclosed herein.
Figure 8B:
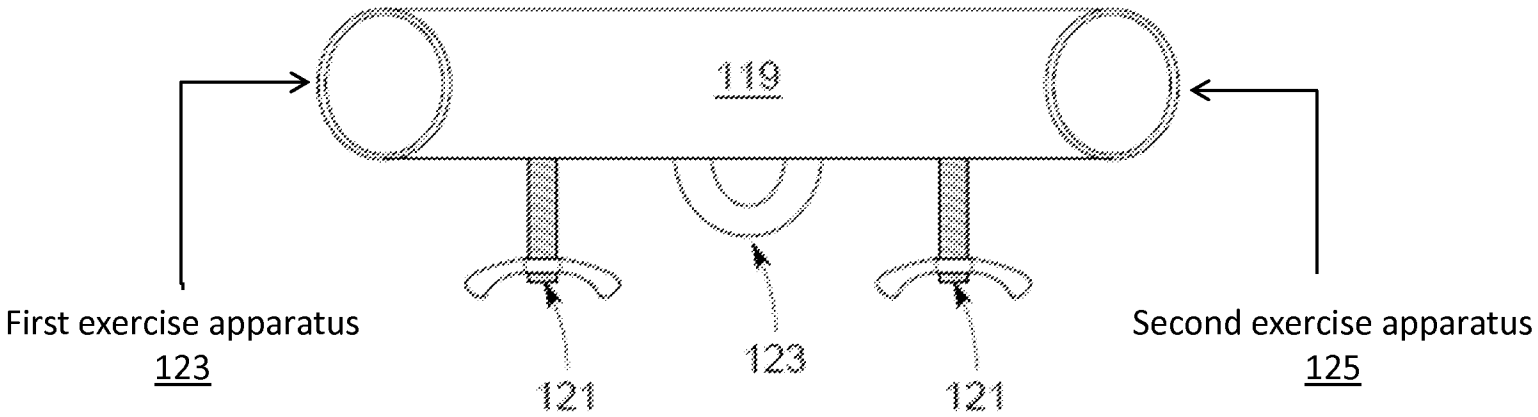

FIGS. 8*a* and 8*b* illustrate a front view of a portable exercise assembly 800 including the first exercise apparatus 123 and the second exercise apparatus 125 selectively coupled using a coupling member 119, according to the embodiments as disclosed herein. The structure of the first exercise apparatus 123 and the second exercise apparatus 125 is substantially similar to the portable exercise apparatus 100.

The first exercise apparatus 123 comprises the bar 101, having the first end 103 and the second end 103 along the longitudinal axis, connected to two frame members 105. Each frame member 105 is coupled to the pair of wheels 109 at the bottom portion of each frame member 105. The second exercise apparatus 123 also comprises the bar 101, having the first end 103 and the second end 103 along the longitudinal axis, connected to two frame members 105. Each frame member 105 is coupled to the pair of wheels 109 at the bottom portion of each frame member 105.

The coupling member 119 selectively couples the first exercise apparatus 123 and the second exercise apparatus 125 to create the portable exercise assembly 800 for performing exercises by the user. The coupling member 119 described herein includes a hollow, cylindrical bar segment which is made of a strong rigid material such as metal or the like.

The coupling member 119 is provided with a plurality of slots/openings for engaging a bolt and nut assembly 121 for connecting and locking the first end 103 or the second end 103 of the first exercise apparatus 123 and the first end 103 or the second end 103 of the second exercise apparatus 125. In an embodiment, the coupling member 119 can be configured to include a hole to attach a clip 123 as shown in the FIG. 8*b*. The clip 123 can be used to perform various conventional band exercises.

The first end 103 and the second end 103 of the first exercise apparatus 123 and the second exercise apparatus 125 extends beyond each frame member 105 and is configured for attachment of free-weights. The portable exercise assembly 800 is adapted to rotate about an axis during an exercise performed by the user. The user performs the exercise by grasping the grip portion 107 of the bar 101 of the first exercise apparatus 123 and the grip portion 107 of the bar 101 of the second exercise apparatus 125. The bar 101 of the first exercise apparatus 123 and the bar 101 of the second exercise apparatus 125 are perpendicular to a vertical axis of each frame member 105.

FIGS. 9*a*-9*e* illustrate example exercises of the many different exercises that can be performed using the portable exercise apparatus, according to the embodiments as disclosed herein. The portable exercise apparatus 100 described herein enables the user to exercise specific or various muscles and muscle groups through at least one mode of operation including a configuration preferable to safely perform the exercise. The various structural configurations of the portable exercise apparatus 100 are designed to assist the user for performing various types of exercises.

Figure 9A:
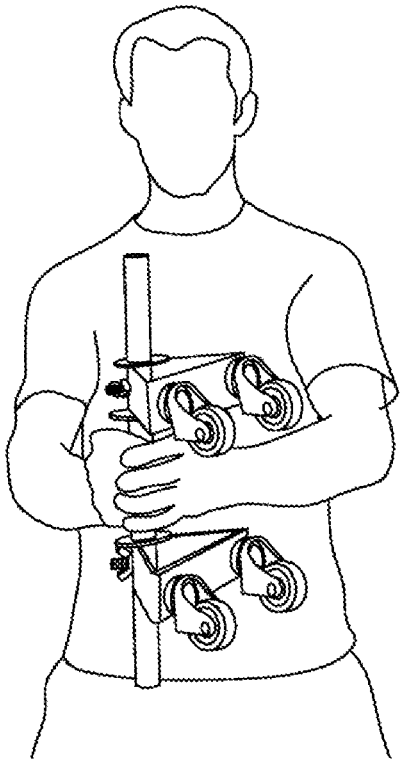
FIGS. 9*a*-9*e* illustrate example exercises of the many different exercises that can be performed using the portable exercise apparatus, according to the embodiments as disclosed herein.
Figure 9B:
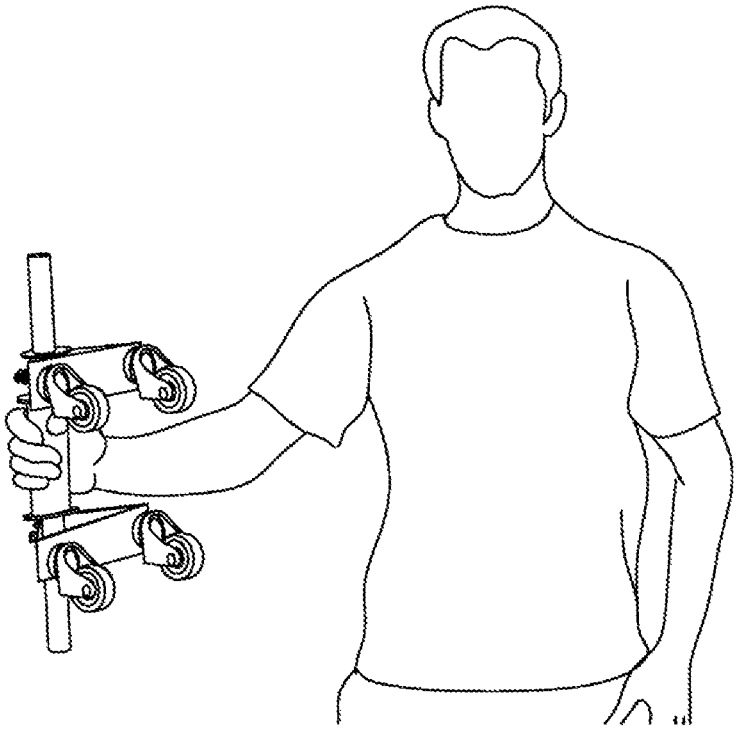
Figure 9C:
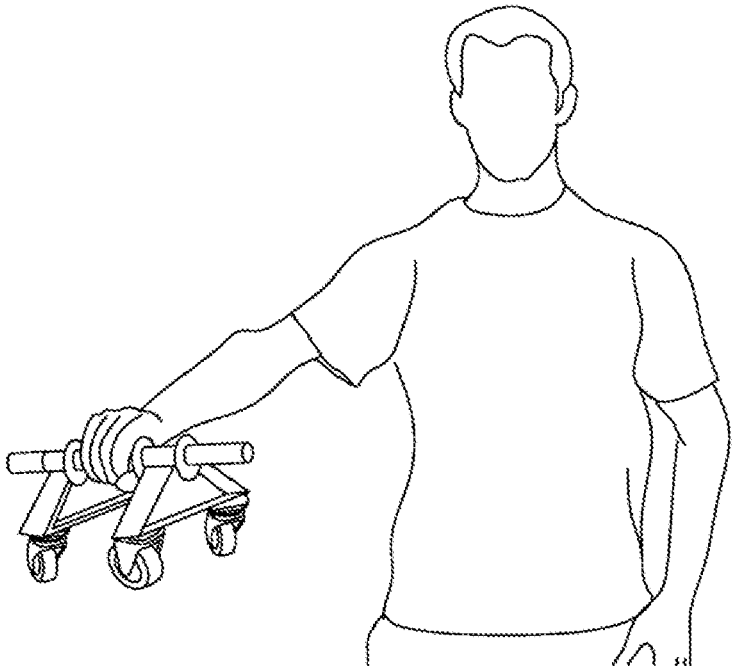

As shown in the FIGS. 9*a*-9*c*, only one portable exercise apparatus 100, optionally attached with weight plates at both the sides, can be used in for performing the exercise. The user can stand with his shoulder width apart and abs drawn in. As shown in the FIG. 9*a*, the portable exercise apparatus 100 may be grasped by both the hands. As shown in the FIGS. 9*b* and 9*c*, the portable exercise apparatus 100 may be grasped by only one hand. As shown in the FIGS. 9*b* and 9*c*, the user may stand straight in an upright posture and spin the frame members 105 around it very rapidly. The hand may remain stationary in space but the frame member 105 may spin creating a significant workload on stabilizing muscle and moving muscles. Further, the portable exercise apparatus 100 may be switched to the other hand and the exercise may be repeated. The exercise may create a cardiovascular effect as well as increase local and core strength.

Figure 9D:
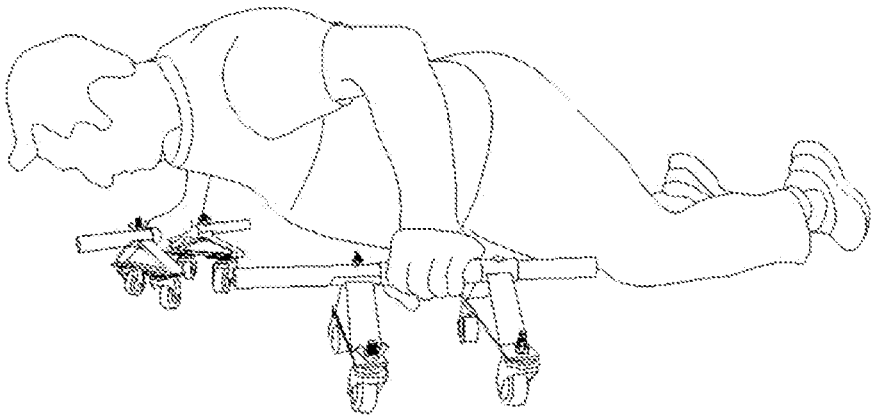

Further, as shown in the FIG. 9*d*, the two portable exercise apparatus 100 are held in user's hand in order to perform a push up exercise. The user may kneel on the floor and grasp the grip portion 107 of one portable exercise apparatus 100 in one hand and the grip portion 107 of another portable exercise apparatus 100 in the other hand. The user may then move shoulders and the upper body towards the floor by lowering the arms as shown in the FIG. 9*d*. The user may then return to the starting position by raising the arms. This motion can then be repeated a desired number of times. The muscles worked in this exercise can include for example, pectoral muscles, triceps, and anterior deltoids.

The pair of wheels 109 on each frame member 105 of the portable exercise apparatus 100 enables the user to roll the portable exercise apparatus 100 in any direction creating different desirable workloads. In order to perform a rolling-push up exercise or dumbbell chest fly, the user may kneel on the floor and grasp the grip portion 107 of the portable exercise apparatus 100 with the hands. The user may roll the portable exercise apparatus 100 on the floor outwards away from the middle of the chest and roll it back towards the middle of the chest. This creates a semi-isolative workload to build muscle and strength in the chest, shoulders, and arms. This motion can then be repeated a desired number of times. The muscles worked in this exercise can include for example, but not limited to, pectoral muscles, triceps, chest, shoulder, arms, and anterior deltoids. For performing another exercise the portable exercise apparatus 100 may be held in the hands and rolled on the floor in any two different directions at the same time. This is designed to give user more functional challenge creating more functional stability, strength and endurance in the shoulders as well abdominals and hips.

In another exercise, the user may use a single portable exercise apparatus 100 to perform dips or push up exercises. The user may balance the entire body by resting the hands on the floor and simultaneously resting both ankles on the first end 103 or the second end 103 of the portable exercise apparatus 100. The user performs the pushup exercise by moving the knee towards abdomen region. The user may then return to the starting position by moving the knee away from the abdomen region. The user can move the portable exercise apparatus 100 in different directions using both the legs creating more functional strength in the hips and abdominals. This motion can then be repeated a desired number of times. The muscles worked in this exercise include abdominal muscles, chest, hips, and legs.

Figure 9E:
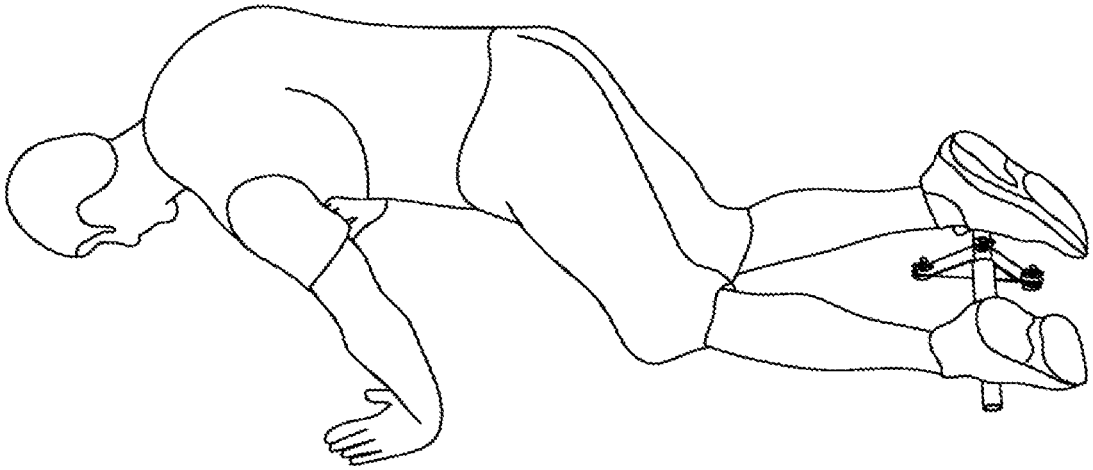

In another exercise, as shown in the FIG. 9*e*, the user may use support of two portable exercise apparatus 100 to perform the dips or push up exercises. The user may balance the entire body by resting the hands on the floor and simultaneously resting ankles spread apart on the portable exercise apparatus 100. The user performs the pushup exercise by moving the knee towards the abdomen region. The user may then return to the starting position by moving the knee away from the abdomen region. The user can move the portable exercise apparatus 100 in different directions creating more functional strength in the hips and abdominals. The user can also move each leg in any direction creating more physical challenge in outer and inner hips. This motion can then be repeated a desired number of times. The muscles worked in this exercise can include for example, but not limited to, abdominal muscles, chest, hips, and legs.

Figure 10A:
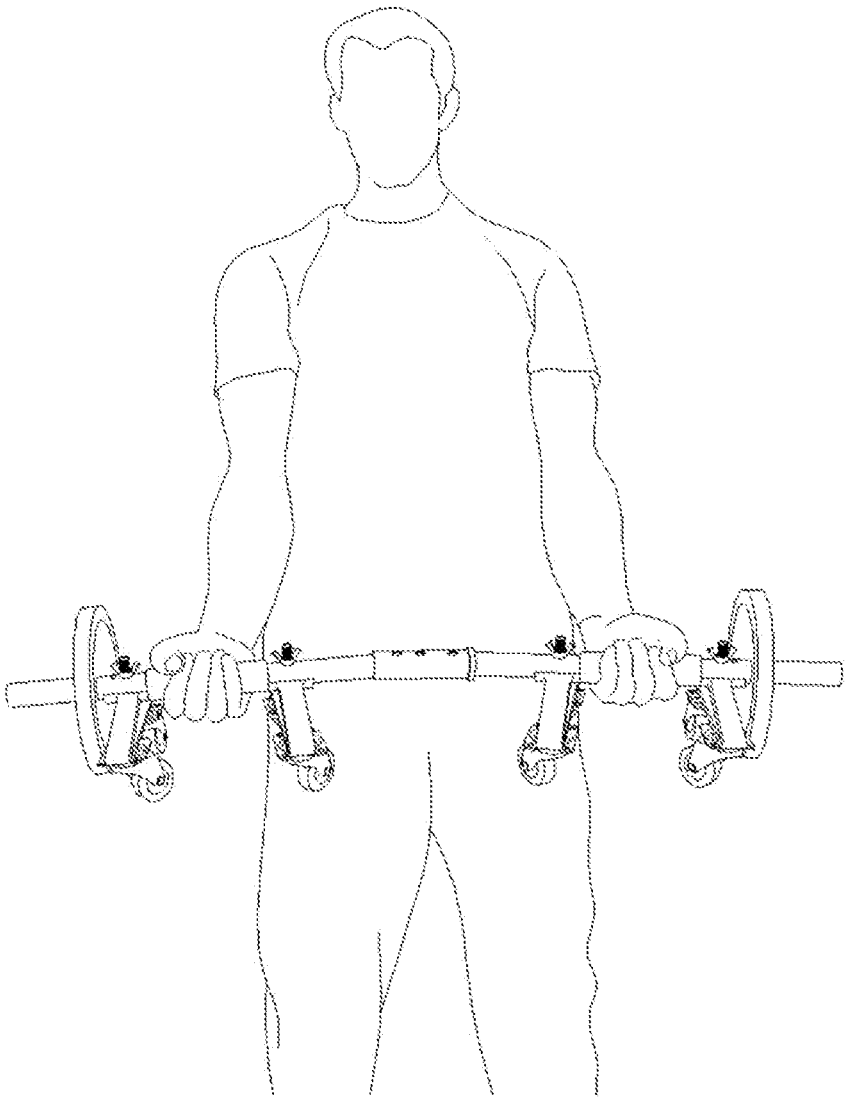
FIGS. 10*a* and 10*b* illustrate example exercises of the many different exercises that can be performed using the portable exercise assembly, according to the embodiments as disclosed herein.
Figure 10B:
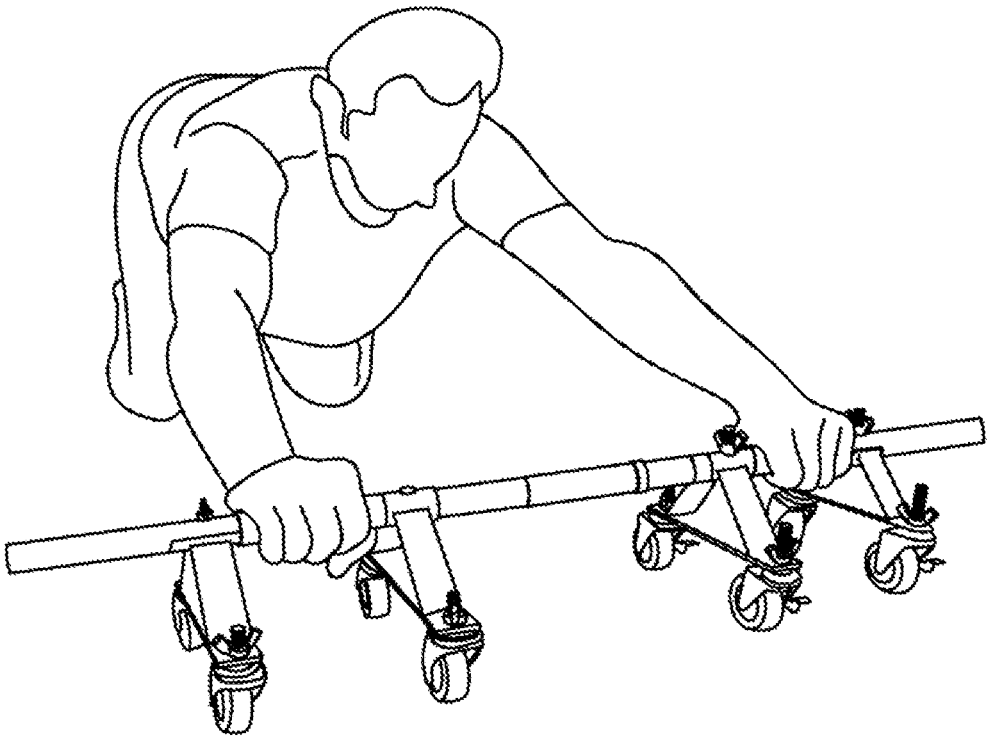

FIGS. 10*a* and 10*b* illustrate example exercises of the many different exercises that can be performed using the portable exercise assembly 800, according to the embodiments as disclosed herein.

The exercises shown in the FIGS. 10*a* and 10*b* provide the ability to create more isolative strength in the upper body and arms by coupling two portable exercise apparatus 100 together to create the portable exercise assembly 800. For the first exercise, the first exercise apparatus 123 and the second exercise apparatus 125 are connected together using the coupling member 119 to form the portable exercise assembly 800 which can be used to perform exercises, such as biceps, triceps, shoulders, forearms, and the like. As shown in the FIG. 10*a*, the user stands in upright position and grasps the grip portion 107 of the first exercise apparatus 123 with one hand and the grip portion 107 of the second exercise apparatus 125 with another hand. The user may move the hands towards the chest and return to starting position by moving the portable exercise assembly 800 away from the chest. This motion can then be repeated a desired number of times. The muscles worked in this exercise can include for example, but not limited to, biceps, the triceps, chest, forearms, and shoulders. In one embodiment, additional weights can be added to the portable exercise assembly 800 at the first end 103 or the second end of the first exercise apparatus 123 or the second exercise apparatus 125. The additional weights 121 can be held in their respective positions by using a clamping assembly or bolt assembly. The intensity of the exercise can be varied based on the amount of weight on the barbell unit.

In the second exercise, the portable exercise assembly 800 can be placed on the floor to perform an exercise which creates more isolative strength and endurance in the shoulders as well abdominals and hips. The user may kneel on the floor and grasp the grip portion 105 of the first exercise apparatus 123 with one hand and the grip portion 107 of the second exercise apparatus 125 with another hand. The user may then roll the portable exercise assembly 800 in a specific direction generally following a straight path as shown in the FIG. 10*b*. The user may then return to the starting position by rolling the portable exercise assembly 800 back towards the knees (i.e. retracing similarly in the straight path). This motion can then be repeated a desired number of times. The muscles worked in this exercise can include for example, but not limited to, abdomen, chest, and shoulders.

The portable exercise assembly 800 and the portable exercise apparatus 100 can be used to perform a large variety of other exercises, such as those listed in the following table, in addition to those illustrated in the FIGS. 9 and 10. The list of exercises in the table is only illustrative and is not intended to be exhaustive.

| Exercises | Exercise Description | Targeted Muscles |
|---|---|---|
| Front Squat | Attach both the dumbbell units to create a barbell unit. Place the barbell unit on your upper chest, resting it across your front deltoids and holding it with the arms crossed securely. Keeping the head and back straight and your abs drawn in and your toes point slightly outward. Slowly squat down so your upper thighs are parallel to the floor. Slowly return to the starting position. | Quads, Calves, and Hamstrings |
| Hack Squat | Attach both the dumbbell units to create a barbell unit. Place the barbell unit on the floor just behind your legs, stand with your feet shoulders width apart and your toes pointing forward. With your feet firmly placed on the floor reach down and grasp the barbell unit from behind with an overhand grip. Lift the barbell unit by extending your hips and knees; be careful not to lock your knees. Lowe yourself (squat) down until your thighs are parallel to the floor. Slowly raise yourself up to starting position. | Quads, Glutes, and Hamstrings |
| One Arm Snatch | Attach both the dumbbell units to create a barbell unit. Stand with your feet shoulders width apart, and a slight bend in your knees. | Quads, Shoulders, Calves, Lats, Abs, Trapezius, and |

-continued

| Exercises | Exercise Description | Targeted Muscles |
|---|---|---|
| | Grasp the barbell unit with an overhead grip. Starting with the barbell unit held slightly above the knees (hand position), lift the weight up over your head then back to shoulder height and finally back to starting position between near your knees. | Hamstrings |
| Body Row | Attach both the dumbbell units to create a barbell unit. Lie under the barbell unit so that the barbell unit is at middle of the chest level and the feet are firmly on the floor. Draw your abs in and keep the back flat. Using the arms, lift and row the body towards the barbell unit. Pause for a moment and with slow controlled movements lower yourself back to starting position. | Chest |
| Dumbbell Bent Arm pull over's | Only one dumbbell unit with weight plates at both the sides is used in this exercise. Lie on a flat bench with your head near or over the end of the bench. Hold the dumbbell above the chest by gripping the weight plate of one side. Keep the elbows slightly bent. Lower the dumbbell unit back behind the head, down towards the floor. The user will feel the stretch in the chest and triceps. Continue until the arms are next to the head. Then reverse the exercise and return to the staring position. | Chest, Shoulders, Triceps, and Lats |
| Ab Rollout | Attach both the dumbbell units to create a barbell unit. Place the barbell unit on the floor at your feet. Bending at the waist, grip the barbell unit with a shoulder with overhand grip. With a slow controlled motion, roll the barbell unit out so that your back is straight. Keep the arms straight throughout the exercise. Roll back up raising the hips and butt as you return to the starting position. | Abs, Shoulders, and Lats |
| Ab Rollout on Knees | Attach both the dumbbell units to create a barbell unit. Place the barbell unit on the floor in front of you. Start by kneeling in front of the barbell unit; grip the barbell with a shoulder with overhand grip. With a slow controlled motion, roll the barbell unit out so that your back is straight, bend your knees and keep the feet off the floor. Keep the arms straight throughout the exercise. Roll back up bring the bar under the shoulders and return to the starting position. | Abs, Shoulders, and Lats |
| Side Bend | Only one dumbbell unit, optionally with weight plates at both the sides, can be used in this exercise. Stand with your feet shoulder width apart, your knees slightly bent and your abs drawn in. Grasp one dumbbell unit in one hand and standing straight upright bend the waist as far as possible to one side. Slowly return backup to the starting position. Switch the dumbbell unit to the other hand and repeat the exercise. | Abs |
| Alternate Bicep Curl | Both dumbbell units, optionally with weight plates at both the sides, are used to perform this exercise. Stand with our feet shoulders width apart, your knees slightly bent and your abs drawn in. Grasp a dumbbell unit in each hand so your palms are facing up. Extend the arms so they are at the sides of your body. Keeping your elbows locked lift the left arm towards the chest so that the forearm touches your bicep. Lower your arm and repeat with the right arm. | Bicep and forearms |
| Bicep Curl with Dead lift | Attach both the dumbbell units to create a barbell unit. Grasp the barbell unit with a close underhand (palm facing up) grip. Standing with your feet shoulder with apart and the knees slightly bent, draw your abs in. Extend the arms so that the barbell unit rests in front of your thighs. Bending at the waist, bring the bar down to just above the floor. As you return to a standing position, bring the barbell unit up and curl your arms bringing | Bicep, Calves, and Hamstring |

-continued

| Exercises | Exercise Description | Targeted Muscles |
|---|---|---|
| | the forearms to your biceps. Return the standing position and repeat. | |
| Bicep curl, Stork Stance | Both dumbbell units, optionally with weight plates at both the sides, are used to perform this exercise. Grasp a dumbbell unit in each hand, palms facing up. Standing on one foot, extend your other foot back and extend your arms don so they are handing in front of your leg. While on one foot, curl the arms up contracting your biceps. Return to the starting position and with legs. | Biceps, Glutes, Triceps, Calves, Quads, and Hamstrings |
| Close Grip barbell unit | Attach both the dumbbell units to create a barbell unit. Stand with your feet shoulders width apart, your knees slightly bent and your abs drawn in. Grasp the barbell unit with an underhand close (4 inch) grip on the innermost part of the barbell unit. Extend the arms fully against the thighs. Keeping the elbows straight, raise the barbell unit towards the chest. Pause for a moment and then return to the starting position. | Biceps and Forearms |
| Close Grip barbell unit curls | Attach both the dumbbell units to create a barbell unit. Stand with your feet shoulders width apart, your knees slightly bent and your abs drawn in. Grasp the barbell unit with an underhand close (palms up) grip about 12 inch apart. Extend the arms fully against the thighs. Keeping the elbows straight, raise the barbell unit towards the chest till the forearms touch the chest. Pause for a moment and then return to the starting position. | Biceps and Forearms |
| Forward Lunge with Bicep curl | Both dumbbell units, optionally with weight plates at both the sides, are used to perform this exercise. Grasp a dumbbell unit in each hand with your palms facing up. Stand with your feet together, your back straight and you abs drawn in. Allow your arms to extend down fully to the sides of your body. While keeping your body straight, take a step forward then your waist and your knee into a lunge. Be careful to let your back knee drop to the floor. As you go into the lunge curl your arms up towards your shoulders contracting your biceps. Return to starting position and switch legs. | Biceps, Glutes, Calves, Quads, Forearms, and Hamstrings |
| Bench press with bands | Lie down flat on a bench and grip the handle unit of each dumbbell unit in each hand. Rest the arms with elbows bent and out to the side. The hands should be at chest level.<br>Push the handle unit up towards the ceiling until the hands are as high as they can go. Hold the top position for a moment then return the hands to the starting position. | Chest and Triceps |
| Bent Arm Pullover | Attach both the dumbbell units to create a barbell unit. Lie flat on a bench with the head near or over the top of the bench. Hold the bar with a narrow grip so that the thumbs are able to touch. The palms should be facing the feet.<br>Start with the elbows at your sides and your elbows bent. Rotate the shoulders so that the barbell unit follows an arc over the head, down towards the floor. In the final position, the arms should be next to the head. | Chest, Shoulders, Triceps, and Lats |

The portable exercise apparatus 100 can be arranged in various adjustable configurations to perform full body strength training and cardiovascular exercises. It allows the user to perform a wide range of exercises to achieve a full body workout, while being inexpensive to fabricate, easily portable, and very compact, so that it can be packed into a small valise or suitcase. It is suitable for use by individuals either at home or while traveling, by personal trainers either at a client's home or at an exercise facility, and by groups at a fitness center or similar facility. The ability to vary the intensity of the individual exercises, e.g., in the manners described above, makes the apparatus suitable for use by anyone from a beginner to a highly conditioned athlete. The parts of the portable exercise apparatus 100 can be fabricated out of metal or, preferably, to the extent practicable, out of a rigid plastic material to minimize the weight of the apparatus.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

I claim:

1. A portable exercise apparatus comprising:

a bar having a first end and a second end along a longitudinal axis; and two frame members, each said frame member with a groove on top, coupled to said bar such that said bar rests on said two frame members along said longitudinal axis of said bar and on said grooves of said two frame members, said two frame members being opposite to each other at each end of said bar, wherein each said frame member is coupled to a pair of wheels at a bottom portion of each said frame member, wherein said bar having a grip portion, between said first end and said second end, to support stresses perpendicular to said longitudinal axis of said bar, wherein said first end and said second end extend beyond each said frame member and are configured for attachment of free-weights.

2. The portable exercise apparatus of claim 1, wherein each said frame member is an "A-shaped"frame having three flat bar segments connected in a triangular pattern.

3. The portable exercise apparatus of claim 1, wherein said bar is coupled to a top portion of each said frame member by means of a bolt and a nut.

4. The portable exercise apparatus of claim 1, wherein each said frame member comprises said bottom portion and a top portion, wherein said top portion is a cap screwed to said bottom portion using two screws on each side of said bar.

5. The portable exercise apparatus of claim 1, wherein said bottom portion comprises said groove on top of said bottom portion and a nib on said groove for said bar to rest on each said frame member without rotating.

6. The portable exercise apparatus of claim 4, wherein said bar is coupled to said top portion of each said frame member by way of a hole resting on a nib on said groove.

7. The portable exercise apparatus of claim 1, wherein said pair of wheels are adjustably attached at said bottom portion of each said frame member by means of a nut and a bolt.

8. The portable exercise apparatus of claim 1, wherein said pair of wheels are adjustably attached at said bottom portion of each said frame member by means of at least one of a pin, axle, and pivot.

9. The portable exercise apparatus of claim 1, wherein each said wheel spins in every direction to spin said portable exercise apparatus in any direction.

10. A portable exercise assembly, comprising:

a first exercise apparatus comprising a bar, having a first end and a second end along a longitudinal axis, connected to two frame members, wherein each said frame member is coupled to a pair of wheels at a bottom portion of each said frame member;

a second exercise apparatus comprising a bar, having a first end and a second end along said longitudinal axis, connected to two frame members, wherein each said frame member is coupled to a pair of wheels at a bottom portion of each said frame member; and a coupling member for selectively coupling said first exercise apparatus and said second exercise apparatus for performing exercises by a user.

11. The portable exercise assembly of claim 10, wherein said first end and said second end of said first exercise apparatus and said second exercise apparatus extend beyond each said frame member and are configured for attachment of free-weights.

12. The portable exercise assembly of claim 10, wherein said portable exercise assembly being adapted to rotate about an axis during an exercise performed by said user, wherein said user performs said exercise by grasping a grip portion of said bar of said first exercise apparatus and a grip portion of said bar of said second exercise apparatus.

13. The portable exercise assembly of claim 10, wherein said bar of said first exercise apparatus and said bar of said second exercise apparatus are perpendicular to a vertical axis of each said frame member.

14. The portable exercise assembly of claim 10, wherein said coupling member comprises a plurality of slots for engaging a bolt and nut assembly for coupling one of said first end and said second end of said first exercise apparatus and one of said first end and said second end of said second exercise apparatus.

* * * * *